US007619173B2

(12) United States Patent
Inoue

(10) Patent No.: US 7,619,173 B2
(45) Date of Patent: Nov. 17, 2009

(54) LIGHT GUIDE SHEET AND MOVABLE CONTACT UNIT AND SWITCH USING THE SAME

(75) Inventor: Takefumi Inoue, Nara (JP)

(73) Assignee: Panasonic Corporation, Osaka (JP)

( * ) Notice: Subject to any disclaimer, the term of this patent is extended or adjusted under 35 U.S.C. 154(b) by 134 days.

(21) Appl. No.: 11/957,783

(22) Filed: Dec. 17, 2007

(65) Prior Publication Data

US 2008/0198625 A1 Aug. 21, 2008

(30) Foreign Application Priority Data

Feb. 20, 2007 (JP) ..... 2007-038995

(51) Int. Cl.
*H01H 9/00* (2006.01)

(52) U.S. Cl. ..... 200/310; 200/314; 345/168; 400/490

(58) Field of Classification Search ..... 200/511–513, 200/310–314; 345/173, 168, 102; 400/490, 400/491; 362/84, 23, 29
See application file for complete search history.

(56) References Cited

U.S. PATENT DOCUMENTS 5,225,818 A * 7/1993 Lee et al. ..... 345/170
5,528,720 A * 6/1996 Winston et al. ..... 385/146
5,661,279 A * 8/1997 Kenmochi ..... 200/314
5,664,667 A * 9/1997 Kenmochi ..... 200/314
5,871,088 A * 2/1999 Tanabe ..... 200/514
6,595,653 B2 * 7/2003 Saito et al. ..... 362/84
7,015,408 B2 * 3/2006 Hirahata et al. ..... 200/310
7,070,349 B2 * 7/2006 Dombrowski et al. ..... 400/490

FOREIGN PATENT DOCUMENTS

EP 1 722 385 A1 11/2006
JP 2006-318905 11/2006
WO WO 01/23805 A1 4/2001

OTHER PUBLICATIONS

Supplementary European Search Report issued in European Patent Application No. 07124083.2-2214, dated Jul. 1, 2008.

* cited by examiner

*Primary Examiner*—Kyung Lee
(74) *Attorney, Agent, or Firm*—McDermott Will & Emery LLP

(57) ABSTRACT

The disclosed relates to a light-guide-sheet used in operation panel of a various electronic equipment, and a movable-contact-unit and a switch using the same, which have a simplified structure free from uneven illumination and a cheap cost price. Therefore, the light-guide-sheet is provided with the light-guide-member including an inlet, a generally strip-shaped guide-path coupled with the inlet, and generally circularly and irregularly shaped light-emitters coupled with the guide-path, each formed from a polymer having an index of refraction different from that of base-film and formed in grooves provided on a base-film.

7 Claims, 3 Drawing Sheets

LIGHT GUIDE SHEET AND MOVABLE CONTACT UNIT AND SWITCH USING THE SAME

CLAIM OF PRIORITY

This application claims the benefit of Japanese Patent Application No. JP 2007-038995, filed on Feb. 20, 2007 the disclosure of which is incorporated herein by reference.

FIELD OF THE INVENTION

The present invention relates to a light-guide-sheet used in operation panel of various electronic equipment, and a movable-contact-unit and a switch using the same.

BACKGROUND OF THE INVENTION

In recent years, an increasing number of users require various electronic equipment especially mobile devices such as cellular phones capable of identifying and operating switches, push-buttons or the like even in dark surroundings by lighting LEDs, EL elements or the like to illuminate the operation panel for a high usability with a cheep price.

The light-guide-sheet and switch using the same for use in such illumination is described with reference to FIGS. 5 and 6. The drawings are shown on an expanded scale in a thickness direction for an easy understanding.

FIG. 5 shows a cross-sectional view of a conventional switch and FIG. 6 shows a perspective view of the light-guide-sheet used in the conventional switch. In the drawing, the conventional switch employs a flexible film-like light-guide-sheet 1 in which the top and bottom surfaces of light-guide-layer 1A are sandwiched between upper protective layer 1B and lower protective layer 1C.

On the top surface of substrate 2 provided with a plurality of wiring patterns (not shown) formed on its top and bottom surfaces, a plurality of stationary contacts 3 are formed that include generally circular central stationary contact 3A and surrounding horseshoe-shaped outside stationary contact 3B.

A plurality of generally dome-shaped movable contacts 4 formed of a thin metal sheet are bonded on stationary contacts 3 by using a sheet (not shown) coated with an adhesive or the like on its bottom surface such that the outside peripheral edges are bonded on outside stationary contacts 3B and the bottom surface center faces central stationary contact 3A with a prescribed clearance.

A plurality of irregularly-shaped light-emitters 1D are formed on light-guide-layer 1A above movable contact 4, and projection 1E is provided on the bottom surface of light-guide-sheet 1 to come into contact with the top surface center of movable contact 4.

Light-emitting-element 5 such as an LED is mounted on substrate 6 on the left side to light-guide-sheet 1, facing its emitting-surface to the left side surface of light-guide-sheet 1, thus forming the conventional switch.

The conventional switch with the above configuration is mounted on an operation panel of electronic equipment, and key-buttons formed from an insulating resin (not shown) is disposed above light-emitters 1D, then central stationary contact 3A and outside stationary contact 3B, light-emitting-elements 5 are connected to electronic circuits (not shown) of the electronic equipment (not shown) via wiring patterns and connectors (not shown) or the like.

In the above configuration, when pressing down a key-button the pressed area of light-guide-sheet 1 bends downward, causing projection 1E to press down the top surface center of generally dome-shaped movable contact 4 to apply a prescribed pressure on the top center of movable contact 4. This reverses movable contact 4 downward elastically with a click feeling, allowing the bottom surface center of movable contact 4 to touch central stationary contact 3A. Therefore, central stationary contact 3A and outside stationary 3B come into the state of electrical connection via movable contact 4.

On the contrary, releasing the downward pressure to the key-button will reverse movable contact 4 upward by an elastic returning force, causing the top surface center of movable contact 4 to depart from central stationary contact 3A and thereby causing central stationary contact 3A and outside stationary 3B to disconnect electrically.

Such electrical connection/disconnection of stationary contacts 3 carries out switching of each function for the equipment accordingly. When a voltage is applied on light-emitting-elements 5 from electronic circuit of the equipment, light-emitting-elements 5 emit light and the light enters into light-guide-layer 1A from the left side surface of light-guide-sheet 1 to illuminate overall light-guide-layer 1A.

Moreover, the light reflected at irregularly-shaped light-emitters 1D in light-guide-layer 1A allows a plurality of light-emitters 1D to illuminate themselves, so that the emitted light illuminates key-buttons (not shown) from below through upper protective layer 1B. Therefore, users can identify and operate key-buttons easily even in dark surroundings.

Japanese Patent Unexamined Publication No. 2006-318905 is known as an example of the Information Disclosure Statement (IDS) relevant to the present invention.

However, in the aforementioned light-guide-sheet and the switch using the same, light-emitting-element 5 is to illuminate the overall light-guide-layer 1A of light-guide-sheet 1, which causes light-emitters 1D located far away from light-emitting-element 5 to become darker due to decrease in light intensity, which tends to cause an uneven illumination.

To reduce the unevenness for a more uniform illumination, many light-emitting-elements are necessary to dispose on the periphery of light-guide-sheet 1 which causes problems of a more complex structure and expensiveness.

SUMMARY OF THE INVENTION

To solve the conventional problems the present invention aims at providing a light-guide-sheet with a simplified structure free from uneven illumination and a cheap cost price, and a movable-contact-unit and a switch using the same.

The light-guide-sheet of the present invention comprises a light-guide-member including: an inlet; a generally strip-shaped guide-path coupled with the inlet; and light-emitters coupled with the guide-path, each formed from a polymer having an index of refraction different from that of base-film and formed in grooves provided on one surface side of a base-film. Since the light-emitting-element illuminates the light-guide-member only in the light-guide-sheet, one single light-emitting-element can perform the illumination free from unevenness, which can provide the light-guide-sheet with a simplified structure and a cheap cost price.

The light-guide-sheet of the present invention has the inlets and light-emitters both shaped irregularly, which enables the light emitted from the light-emitting-element to enter into the light-paths and to illuminate light-emitters themselves brightly by reflecting the light at the inlets and at the light-emitters.

Moreover, the movable-contact-unit of the present invention has a plurality of generally dome-shaped movable contacts formed of electrically conductive thin metal sheet bonded on the bottom surface of the light-guide-sheet, which provides the movable-contact-unit with a simplified structure free from uneven illumination and a cheap cost price.

Moreover, the switch of the present invention has a movable-contact-unit bonded on the top surface of a substrate on which a plurality of stationary contacts are provided facing a movable contact to provide the switch with a simplified structure and a cheap cost price As described above, the present invention can realize the light-guide-sheet with a simplified structure free from uneven illumination and a cheaper cost price and a movable-contact-unit and switch using the same.

DETAILED DESCRIPTION OF THE INVENTION

The present invention is described by following preferred embodiments with reference to FIG. 1 through FIG. 4. The drawings are shown on an expanded scale in a thickness direction for easy understanding.

Embodiment

Figure 1:
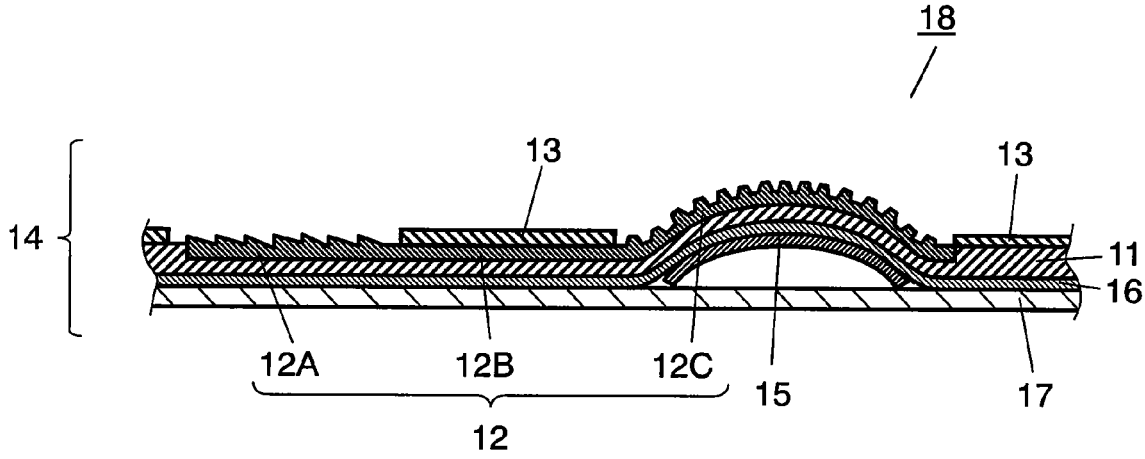
FIG. 1 is a cross-sectional view of the movable-contact-unit used in the preferred embodiment of the present invention.
Figure 2:
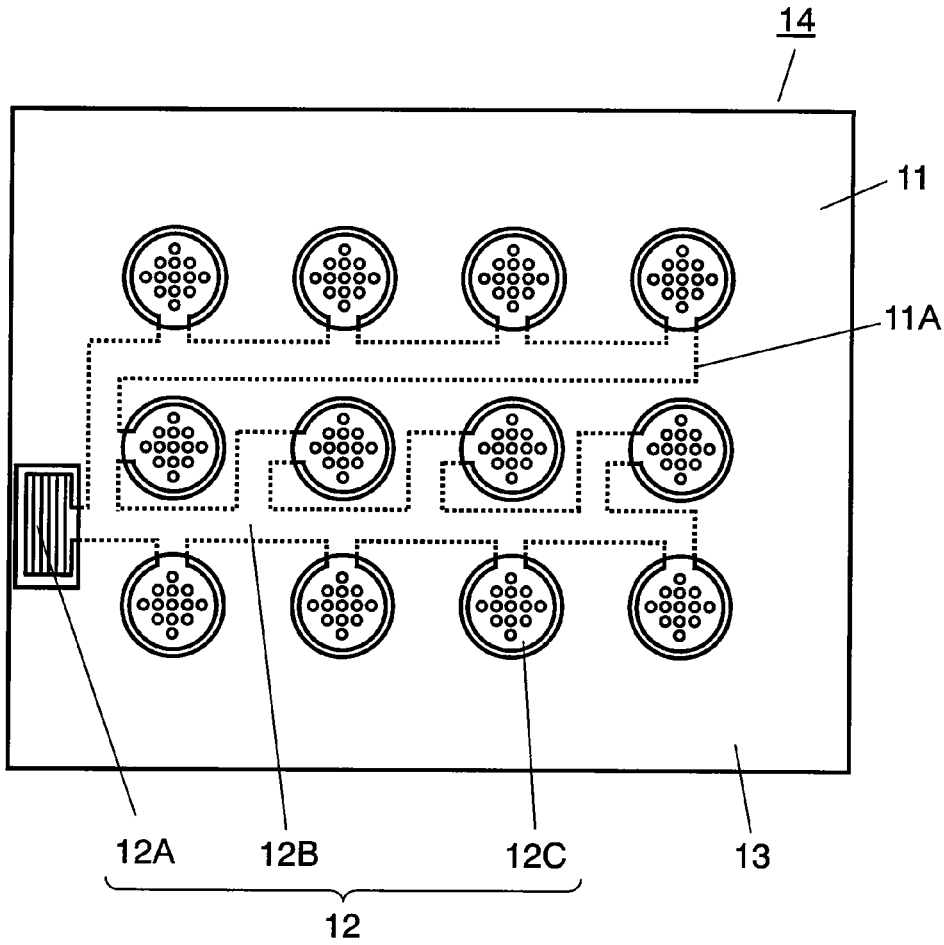
FIG. 2 is a plan view of the light-guide-sheet used in the movable-contact-unit shown in FIG. 1.

FIG. 1 is a cross-sectional view of movable-contact-unit 18 used in the preferred embodiment of the present invention, FIG. 2 is a plan view of the light-guide-sheet used in movable-contact-unit 18. In the drawings, base-film 11, with a thickness of 25 to 250 μm and an index of refraction of 1 to 2, is formed from a polymer such as silicone, urethane, polycarbonate or polyethylene-terephthalate series, and a plurality of coupled grooves 11A are provided on the top surface of base-film 11.

Light-guide-member 12 formed from a polymer similar to a material of base-film 11 and with the index of refraction different from that of base-film 11 is provided in grooves 11A on base-film 11, which includes: inlet 12A; a plurality of strip-shaped guide-path 12B coupled with inlet 12A; and a plurality of generally circular light-emitters 12C coupled with guide-paths 12B.

Cover film 13 is bonded on the top surface of base-film 11, exposing inlet 12A and light-emitters 12C, and the top surface of inlet 12A and the top surface of light-emitters 12C are shaped irregularly, thus forming the light-guide-sheet 14.

The aforementioned light-guide-sheet 14 can be manufactured with comparative ease: firstly, light-guide-member 12 is formed in grooves 11A following the molding process of the grooves 11A on base-film 11, or light-guide-member 12 is provided in grooves 11A afterward by printing or the like, and lastly cover film 13 is bonded on the top surface.

The movable-contact-unit 18 has a generally dome-shaped movable contacts 15 formed of an electrically conductive thin metal sheet, such as copper alloy sheet or steel sheet. The convex top surface center of a plurality of movable contacts 15 are bonded on the bottom surface of light-guide-sheet 14 below light-emitter 12C by adhesive layer 16 composed of acrylic, silicone butyl-rubber or the like.

A film-like separator 17 formed from polyethylene-terephthalate or the like is bonded on the bottom surface of light-guide-sheet 14 to so as to cover the overall bottom surface of light-guide-sheet 14 to protect the bottom surface of movable contacts 15 from attaching dust or the like during storage or transportation, thus forming movable-contact-unit 18.

Figure 3:
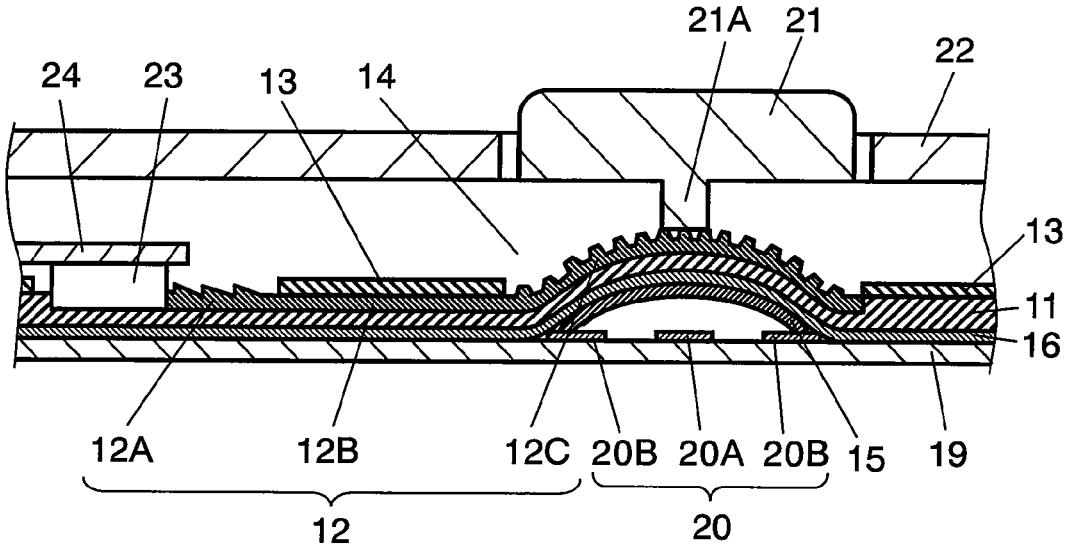
FIG. 3 is a cross-sectional view of the switch used in the preferred embodiment of the present invention.
Figure 4:
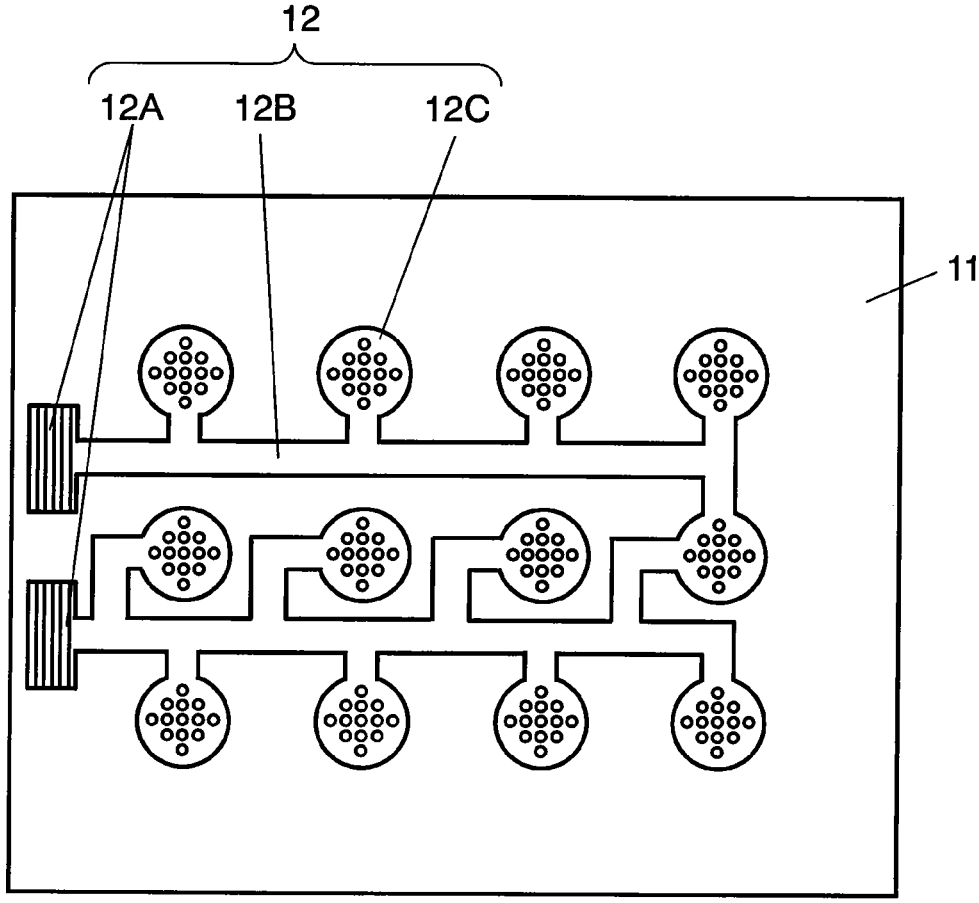
FIG. 4 is a plan view of the light-guide-sheet used in another preferred embodiment of the present invention.
Figure 5:
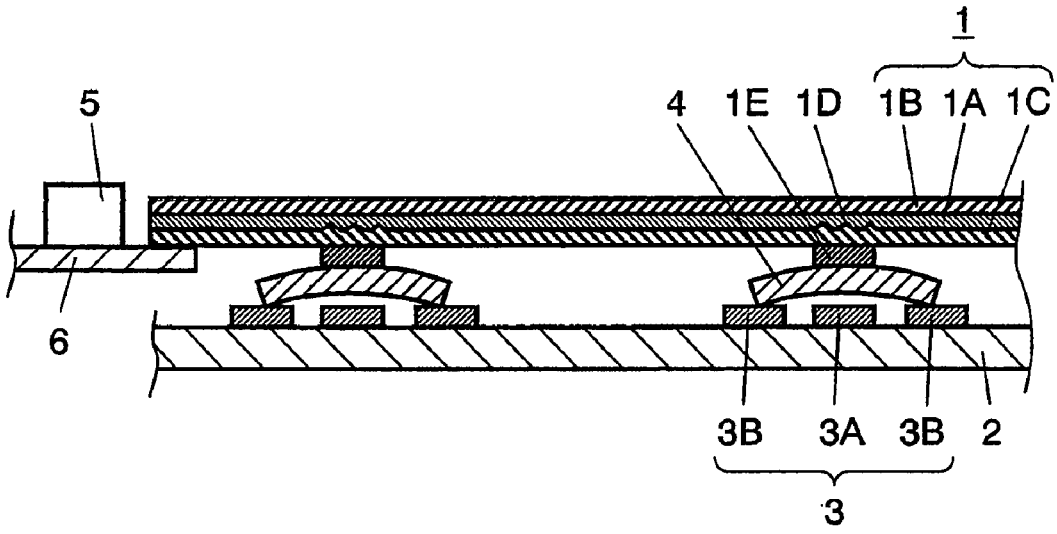
FIG. 5 PRIOR ART
FIG. 5 is a cross-sectional view of a conventional switch.
Figure 6:
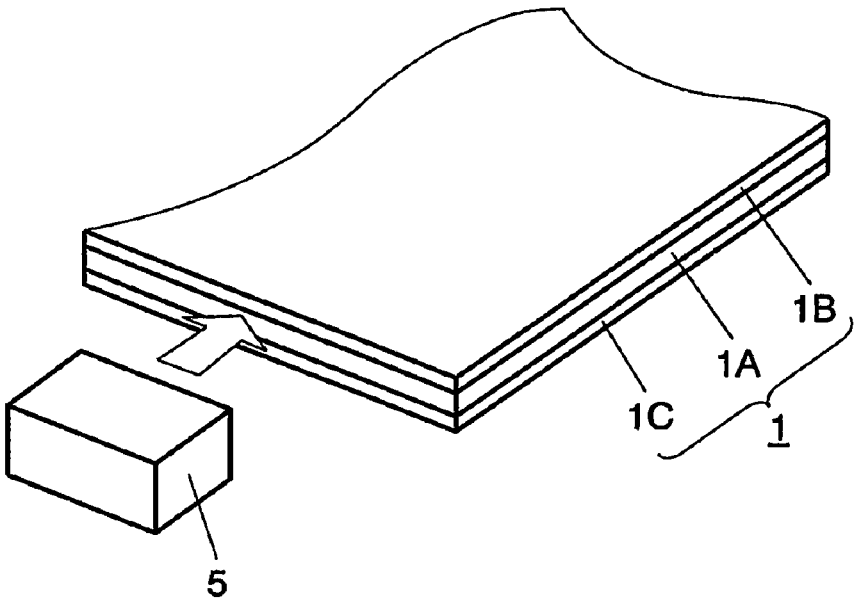
FIG. 6 PRIOR ART
FIG. 6 is a perspective view of a conventional light-guide-sheet.

FIG. 3 shows a cross-sectional view of the switch used in the preferred embodiment of the present invention. In FIG. 3, a plurality of wiring patterns (not shown) are formed using copper or the like on the top and bottom surfaces of circuit board 19 formed from paper-phenol, glass-epoxy or the like, and a plurality of stationary contacts 20 including generally circular central stationary contact 20A and surrounding horseshoe-shaped outside stationary contact 20B is formed on the top surface of circuit board 19 using copper, carbon or the like.

Movable-contact-unit 18, after peeling off separator 17, is bonded on the top surface of circuit board 19 by using adhesive layer 16 such that the peripheral edge of each movable contact 15 is mounted on outside stationary contact 20B and the bottom surface center of movable contact 15 faces each central stationary contact 20A with a prescribed clearance.

A plurality of key-buttons 21 formed from an insulating resin are mounted on case 22 covering movable-contact-unit 18 freely in vertical motion, and projection 21A projected downward from the bottom surface of key-button 21 comes into contact with the top surface of light-emitter 12C of light-guide-sheet 14.

Light-emitting-element 23 such as an LED is mounted on substrate 24 shown on the left side in FIG. 3 directing its emitting surface to inlet 12A of light-guide-sheet 14, thus forming the switch of the preferred embodiment of the present invention.

In FIG. 3, light-emitting-element 23 is mounted directing its emitting surface to the side surface of inlet 12A of light-guide-sheet 14 to guide the light to inlet 12A of light-guide-sheet 14 from a side surface of light guide 14, thus showing the preferred embodiment of the present invention. Meanwhile, another embodiment is also feasible, though not shown in the drawing, in which light-emitting-element 23 is mounted on the top surface of inlet 12A of light-guide-sheet 14 directing its emitting surface to the top surface of inlet 12A and to guide the light to inlet 12A from the top surface of light-guide-sheet 14.

In this embodiment, it is necessary to form a structure to bend the light from below toward the right direction in order to guide the light guided from the top surface of inlet 12A to the direction of light-emitter 12C shown on the right side in FIG. 3. The structure can be realized using the principle of mirror or prism.

The switch with the configuration is mounted on the operation panel of various electronic equipment, and then central stationary contact 20A, outside stationary contact 20B and light-emitting-element 23 are connected to electronic circuits (not shown) of various electronic equipment via wiring patters or connectors or the like.

In the above configuration, when pressing down key-button 21 the pressed area of light-guide-sheet 14 bends downward, causing projection 21A to press down the top surface center of generally dome-shaped movable contact 4 to apply a prescribed pressure on the top center of movable contact 15 via light-emitter 12C and base-film 11. This reverses movable contact 15 downward elastically with a click feeling, allowing the bottom surface center of movable contact 15 to touch central stationary contact 3A. Therefore, central stationary contact 20A and outside stationary 20B come into the state of electrical connection via movable contact 15.

On the contrary, when releasing the downward pressure to key-button 21, movable contact 15 will reverse upward by an elastic returning force, causing the top surface center of movable contact 15 to depart from central stationary contact 20A and thereby causing central stationary contact 20A and outside stationary 20B to disconnect electrically.

Such electrical connection/disconnection of stationary contacts 20 by the pressing operation of key-button 21 carries out switching action of each function for the equipment accordingly. When a voltage is applied on light-emitting-element 23 from electronic circuit of the equipment, light-emitting-element 5 emits light and the light enters into inlet 12 of light-guide-sheet 14.

In an embodiment, though not shown in the drawing, in which light-emitting-element 23 is mounted above inlet 12A of light-guide-sheet 14, light emitted downward from light-emitting-element 23 reflects at the irregularly-shaped top surface of inlet 12A to enter into the generally strip-shaped guide-path 12B.

The light from light-emitting-element 23 travels through a generally strip-shaped light-guide-member 12 having an index of refraction different from that of base-film 11 provided in grooves 11A of base-film 11 from inlet 12A to a plurality of guide-paths 12B achieving total internal reflection or refraction without any leakage to outside, and is finally guided to a plurality of light-emitters 12C.

The light that has traveled through guide-path 12B reflects at the irregularly-shaped light-emitters 12C and allows a plurality of light-emitters 12C to emit light and then the light illuminates key-buttons 21 from below. Therefore, users can identify and operate the operation panel easily even in dark surroundings.

Namely, instead of illuminating overall light-guide-sheet 14, the light emitted from light-emitting-element 23 is guided only inside of light-guide-member 12 having an index of refraction different from that of base-film and the light reflects at light-emitters 12C, which illuminate key-buttons 21. Therefore, one single light-emitting-element 23 can perform an even and uniform illumination on all light-emitters 12C.

In the aforementioned embodiment in which light-emitting-element 23 is mounted above inlet 12A, the top surfaces of inlet 12A and light-emitter 12C are shaped irregularly, so that the light from light-emitting-element 23 reflects from downward to rightward at inlet 12A to guide the light to guide-path 12B. Additionally, the light reflects at light-emitters 12C to illuminate a plurality of corresponding upside key-buttons 21, which can perform an even, uniform and bright illumination.

Moreover, cover-film 13 is bonded on the top surface of light-guide-sheet 14 to cover guide-path 12B except inlet 12A and light-emitter 12C to prevent the light from leaking from light-path 12B having comparatively larger area than inlet 12A or light-emitter 12C, which can prevent a decrease in brightness in a plurality of light-emitters 12C.

In the configuration described above, light-guide-sheet 14 is provided with a single inlet 12A and a plurality of guide-paths 12B coupled with the inlet, and a plurality of light-emitters 12C. However, in another preferred embodiment of the present invention shown in a plan view of FIG. 4, this light-guide-sheet 14 is provided with two inlets 12A and a plurality of guide-paths 12B and a plurality of light-emitters 12C are formed between these two inlets. Light entering from these two inlets 12A may generate a brighter illumination.

Additionally, when two light-emitting-elements 23 to emit light into two inlets 12A are each provided with different light color, two different colors of light emitted from the two inlets 12A can illuminate light-emitters 12C in upper half and lower half of light-guide-member 12 in different colors and light emitters 12C in intermediate portion in an intermediate color, which can realize a various modes of illumination.

As described above, the light-guide-sheet 12 of the present embodiment comprises light-guide-member 12 formed in grooves 11A provided on one surface side of a base-film 11. Light-guide-member 12 includes: inlet 12A, a generally strip-shaped guide-path 12B coupled with inlet 12A, and generally circular light-emitters 12C coupled with the guide-path 12B, each formed from a polymer having an index of refraction different from that of base-film 11. This can provide light-guide-sheet 14 with a simplified structure free from uneven illumination and a cheap cost price, and movable contact unit 18 and the switch using the same.

In the above, it is described that grooves 11A are provided on the top surface of base-film 11 and a plurality of light-emitters 12C are formed in generally circular-shaped. The present invention, however, can be implemented when grooves 11A are formed on the bottom surface or both top and bottom surfaces of base-film 11, or when light-emitters are formed in generally rectangular-shaped.

The light-guide-sheet, and the movable contact and switch using the same of the present invention have a simplified structure free from uneven illumination, and a cheap cost price, and is useful to operate various electronic equipment and have a very high industrial applicability.

What is claimed is:

1. A light-guide-sheet comprising:

a base film having grooves; and a light-guide-member formed in the grooves of the base-film comprising;

an inlet, a generally strip-shaped light-guide path coupled with the inlet, and a light-emitter coupled with the light-guide path, each having an index of refraction different from that of the base-film.

2. The light-guide-sheet of claim 1, wherein the inlet and the light-emitter are shaped irregularly.

3. A movable-contact-unit having the light-guide-sheet of claim 1, wherein a plurality of generally dome-shaped movable contacts formed of a thin metal sheet are bonded on a bottom surface of the light-guide-sheet.

4. The movable-contact-unit of claim 3, wherein the movable contacts are bonded on a bottom surface of the light-emitter of the light-guide-sheet.

5. A switch comprising a movable-contact-unit of either claim 3 or 4 and a board provided with a plurality of stationary contacts, wherein the stationary contacts are bonded on a top surface of the board and each of the stationary contacts are disposed on a position facing each of a plurality of the movable contacts of the movable-contact-unit.

6. The light-guide-sheet of claim 1, wherein the base film includes a reduced-thickness section on which the light-guide-member is arranged.

7. The light-guide-sheet of claim 1, wherein the light-guide-member is configured so that received light is internally reflected or refracted within the light-guide-member.

* * * * *

UNITED STATES PATENT AND TRADEMARK OFFICE

CERTIFICATE OF CORRECTION

PATENT NO. : 7,619,173 B2
APPLICATION NO. : 11/957783
DATED : November 17, 2009
INVENTOR(S) : Takefumi Inoue It is certified that error appears in the above-identified patent and that said Letters Patent is hereby corrected as shown below:

On the title page, in Item "(56) References Cited", under "FOREIGN PATENT DOCUMENTS", Please delete the reference "WO WO 01/23805 A1 4/2001" and add --WO 01/23805 A1 4/2001--

Signed and Sealed this

Twenty-fifth Day of May, 2010

David J. Kappos

David J. Kappos
*Director of the United States Patent and Trademark Office*